US005721048A

United States Patent [19]

Schmalz

[11] Patent Number: 5,721,048

[45] Date of Patent: Feb. 24, 1998

[54] CARDABLE HYDROPHOBIC POLYOLEFIN FIBER, MATERIAL AND METHOD FOR PREPARATION THEREOF

[75] Inventor: A. Chandler Schmalz, Conyers, Ga.

[73] Assignee: Fiberco, Inc., Wilmington, Del.

[21] Appl. No.: 220,465

[22] Filed: Mar. 30, 1994

Related U.S. Application Data

[63] Continuation of Ser. No. 914,213, Jul. 15, 1992, abandoned, which is a continuation of Ser. No. 614,650, Nov. 15, 1990, abandoned.

[51] Int. Cl.[6] ..... D04H 1/40; D04H 1/70; D04H 3/02

[52] U.S. Cl. ..... 428/369; 28/247; 156/305; 156/308.2; 156/308.8; 252/8.84; 427/412; 442/333; 428/362; 428/375; 428/391; 428/394

[58] Field of Search ..... 156/305, 308.2, 156/308.8; 428/288, 290, 369, 375, 391, 394; 28/247; 427/412; 442/333

[56] References Cited

U.S. PATENT DOCUMENTS

| | | | |
|---|---|---|---|
| T917,002 | 12/1973 | Sanders . | |
| 3,009,830 | 11/1961 | Levine . | |
| 3,341,451 | 9/1967 | Dziuba et al. | 252/8.6 |
| 3,377,181 | 4/1968 | Kamijo et al. | 252/8.6 |
| 3,423,314 | 1/1969 | Campbell | 427/393.1 X |
| 3,433,008 | 3/1969 | Gage . | |
| 3,544,462 | 12/1970 | Finch et al. | 252/8.6 |
| 3,652,419 | 3/1972 | Karl | 252/8.8 |
| 3,821,021 | 6/1974 | McMillin . | |
| 3,919,097 | 11/1975 | Park . | |
| 3,926,816 | 12/1975 | Cohen et al. | 252/8.9 |
| 3,983,272 | 9/1976 | Huber et al. | 428/391 X |
| 4,058,489 | 11/1977 | Hellsten . | |
| 4,069,159 | 1/1978 | Hayek . | |
| 4,069,160 | 1/1978 | Hawkins . | |
| 4,072,617 | 2/1978 | Jahn . | |
| 4,082,887 | 4/1978 | Coates . | |
| 4,105,567 | 8/1978 | Koerner et al. . | |
| 4,105,569 | 8/1978 | Crossfield . | |
| 4,137,181 | 1/1979 | Hawkins . | |
| 4,143,206 | 3/1979 | Jager | 427/393.1 X |
| 4,179,543 | 12/1979 | Hawkins . | |
| 4,273,600 | 6/1981 | Luke . | |
| 4,283,292 | 8/1981 | Marshall et al. . | |
| 4,285,748 | 8/1981 | Booker et al. . | |
| 4,291,093 | 9/1981 | Wishman et al. . | |
| 4,294,883 | 10/1981 | Hawkins . | |
| 4,306,929 | 12/1981 | Menikheim et al. . | |
| 4,369,134 | 1/1983 | Deguchi et al. | 252/526 |
| 4,423,092 | 12/1983 | Huhn et al. . | |
| 4,511,489 | 4/1985 | Requejo et al. . | |
| 4,535,013 | 8/1985 | Kuhn | 156/308.2 X |
| 4,624,793 | 11/1986 | Phifer et al. . | |
| 4,705,704 | 11/1987 | Lane et al. | 427/393.1 X |
| 4,717,507 | 1/1988 | Schwadtke et al. . | |
| 4,816,336 | 3/1989 | Allou et al. . | |
| 4,837,078 | 6/1989 | Harrington . | |
| 4,938,832 | 7/1990 | Schmalz | 156/308.8 |
| 4,965,301 | 10/1990 | Leininger . | |
| 4,995,884 | 2/1991 | Ross et al. . | |
| 5,033,172 | 7/1991 | Harrington . | |
| 5,045,387 | 9/1991 | Schmalz . | |
| 5,232,742 | 8/1993 | Chakravarti . | |

FOREIGN PATENT DOCUMENTS

| | | |
|---|---|---|
| 0010764 | 5/1980 | European Pat. Off. . |
| 0400622 | 12/1990 | European Pat. Off. . |
| 0486158 | 10/1991 | European Pat. Off. . |
| 2351152 | 5/1977 | France . |
| 1494751 | 7/1964 | Germany . |
| 828735 | 2/1960 | United Kingdom . |
| 0999199 | 12/1963 | United Kingdom . |
| 1246134 | 9/1971 | United Kingdom . |
| 1533359 | 5/1976 | United Kingdom . |

OTHER PUBLICATIONS

Search Report and Annex for European Patent Application 93 301027.

Japanese Patent No. 87 052072 (Derwent Abstract).

Japanese Patent No. 87 047989 (Derwent Abstract).

Japanese Patent No. 82 002828 (Derwent Abstract).

George A. Goulston Company, Technical Data Report, entitled "Lurostat AS–Y Anionic Antistatic Agent".

Declaration of Roger J. Crossfield under 37 C.F.R. 1.132.

European Search Report and Annex.

Kirk–Othmer, *Encyclopedia of Chemical Technology*, Third Edition, vol. 22, 1983 (John Wiley & Sons—New York) pp. 359–361.

Zimmerman et al., *Supplement IV to the* 1953 *Edition of Handbook of Material Trade Names*, p. 126.

*Primary Examiner*—James C. Cannon

*Attorney, Agent, or Firm*—Greenblum & Bernstein, P.L.C.

[57] ABSTRACT

An improved method for producing hydrophobic polyolefin-containing staple fiber for processing, with reduced waste and improved crimp by sequential treatment with two finish compositions comprising at least one neutralized phosphoric acid ester and at least one polysiloxane of defined classes and amounts.

34 Claims, No Drawings

CARDABLE HYDROPHOBIC POLYOLEFIN FIBER, MATERIAL AND METHOD FOR PREPARATION THEREOF

This application is a continuation of application Ser. No. 07/914,213, filed Jul. 15, 1992, now abandoned, which is a continuation of application Ser. No. 07/614,650, filed Nov. 15, 1990, now abandoned.

The present invention relates to an improved process using topically applied fiber finishes to produce polyolefin-containing hydrophobic fiber or filament capable of accepting a high crimp without undue end waste from crimping, cutting and carding operations and without undue loss of desired hydrophobicity in the resulting fiber or nonwoven end product.

BACKGROUND

While the use of fiber finishes is well known in the textile art, attempts to broadly apply such knowledge to produce hydrophobic cardable staple fiber for fluid-absorbing products in the area of personal hygiene, such as catamenial devices, disposable diapers, incontinence pads and the like, have met with substantial technical problems.

In general, such products require a fluid-absorbent core component, usually comprising one or more layers of absorbent material such as wood pulp, rayon, gauze, tissue and the like and, in some cases, synthetic hydrophilic material such as a hydrophilic polyurethane foam and paper absorbent powder.

Such fluid-absorbing core is most frequently fabricated in the form of a bonded pad of wood pulp with or without super absorbent powder, and possesses a rectangular or somewhat oval shape.

To protect a wearer's clothing, and surrounding areas from stain due to fluid leaks a fluid-impervious barrier sheet component is usually positioned external to the core component and the core is also separated from the body of the user by at least an internally-positioned water-permeable coversheet component.

In general, the porosity and fluid-passing properties of the coversheet and the fluid repellant properties of the barrier layer plus lee cuffs and borders of the cover sheet are vital to the proper function of the finished product.

A particularly troublesome technical problem arises when a high degree of hydrophobicity is desired on cuffs or borders in a diaper or similar product produced substantially from conventionally-bonded webs of hydrophobic fiber such as polyolefin-containing staple. This problem arises because untreated finish-free hydrophobic fiber quickly becomes unworkable due to friction and accumulated static charges generated during conventional processing such as spinning, crimping, cutting and carding. For this reason, the art recognizes and uses topically applied fiber finishes which can change fiber surface properties sufficiently to permit processing. Unfortunately, however, such treatment also produces fibers and webs which are substantially more hydrophilic than generally desired and difficult to control quality-wise. In particular, because of the nature of commercial high speed fiber-processing operations, and the unpredictable affinity of known finishing agents to individual batches or bales of hydrophobic fiber, it becomes very difficult to obtain a full crimp in the fiber component and to maintain a uniform hydrophobicity in the final non-woven product.

It is an object of the present invention to prepare hydrophobic fiber or filament suitable for production of nonwoven material having a high hydrophobicity.

It is a further object of the present invention to increase overall processing efficiency of polyolefin-containing fiber or filament as reflected in reduced waste and achievement of a higher crimp value.

THE INVENTION

The above objects are obtained in accordance with the present invention by processing polyolefin-containing spun fiber or filament in accordance with the steps of A. initially treating corresponding continuous spun fiber or filament with an effective amount, preferably varying from about 0.09%–0.5%, applied and based on fiber weight, of a first modifier composition comprising (a) up to about 40%, and preferably about 20 to 40%, by weight of modifier (spin finish) composition of at least one neutralized phosphoric acid ester represented by the formula $$(\mathrm{Alk}-\mathrm{O})_n-\overset{\overset{\displaystyle O}{\|}}{\mathrm{P}}-(\mathrm{OR})_m \qquad (1)$$

wherein Alk is individually defined as a lower alkyl group, such as a 1–8 carbon alkyl and preferably a 1–4 carbon alkyl group;

R is defined as an amino group or an alkali metal, n and m are individually defined as positive numbers of not less than about 1, the sum of which is about 3; and (b) about 100%–60% by weight of first modifier composition of at least one polysiloxane represented by the formula $$X-\left(\begin{array}{c}R'\\ |\\ Si-O\\ |\\ R'\end{array}\right)_o-Y \qquad (2)$$

wherein X and Y are individually defined as a hydrophobic chemical end group such as a lower alkyl group, R' is individually-defined as a lower alkyl such as a methyl group, and o is defined as a positive number within the range of about 10–50 or higher;

B. crimping the resulting continuous fiber or filament;

C. applying to said continuous fiber or filament, preferably at a point proximate to said crimper, an effective amount, varying from about 0.05%–0.80% by fiber weight, of a second modifier finish composition comprising (a) about 100%–50%, by weight of second modifier (over finish) composition, of at least one neutralized phosphoric acid ester represented by formula (1) supra; and (b) up to about 50%, by weight of second modifier composition, of at least one polysiloxane represented by formula (2) supra, in sufficient amount to obtain a final cumulative concentration within a range of about 0.01% to 1.0% and preferably 0.03%–0.8%, based on fiber weight;

D. processing the resulting modifier-treated fiber or filament, to obtain and compile one or more webs for bonding; and E. bonding the resulting web(s) in a conventional manner to obtain a desired hydrophobic nonwoven material.

For present purposes the term "polyolefin-containing spun fiber or filament" includes continuous as well as staple melt spun fibers which are obtainable from conventionally blended isotactic polypropylene as well as art-recognized hydrophobic copolymers thereof with ethylene, 1-butene, 4-methylpentene-1 and the like. The resulting blended and extruded spun melt conveniently has a weight average varying from about $3\times10^5$ to about $5\times10^5$, a molecular weight distribution of about 2.0–12.0, a melt flow rate of about 5–70 g/10 minutes, and a spin temperature conveniently within a range of about 220° C.–325° C.

Also includible within the spun melt are various art-recognized fiber additives, including pH stabilizers such as calcium stearate, antioxidants, pigments, including whiteners and colorants such as $TiO_2$ and the like. Generally such additives vary, in total amount, from about 0.05%–3% by weight of spun melt.

The present invention is found particularly applicable to high speed production of a variety of nonwoven materials utilizing webs obtained, for instance, from carded staple and may also comprise additional web components such as fibrillated film and the like. In each case, the fiber-handling difficulties generated by friction and accumulated static charge can be minimized or avoided without unacceptable sacrifice in bonding characteristics (i.e. strength), loss in fluid permeability or desired hydrophobic properties of the final product.

In this regard the term "processing", as above-applied in process step "D", is inclusive of art-recognized web formation techniques applicable to continuous as well as crimped, cut and carded staple fiber, the crimping step, in the former case, being optional with respect to webs formed solely of fiber or filament.

Continuous spun fiber or filaments used to form webs within the scope of the present invention preferably comprise topically treated spun melt staple fiber, filament, or fibrillated film of bicomponent or monofilament types, the above-defined modifier compositions or finishes being conventionally applied by drawing over a feed wheel partially immersed in a bath of an above-defined modifier composition, dipped therein, or sprayed in effective amount for fiber processing, and dried.

For present purposes, webs used to form nonwovens within the scope of the present invention can be formed by spun bonded, melt blown or conventional "Dry" carded Process using staple fiber and bonded together using techniques employing adhesive binders (U.S. Pat. No. 4,535,013), calender rolls, hot air, sonic, laser, pressure bonding, needle punching and the like, known to the art.

Webs used to fabricate nonwoven material can also usefully comprise conventional sheath/core (concentric or otherwise) or side-by-side bicomponent fiber or filament, alone or combined with treated or untreated homogenous-type fiber or filament and/or fibrillated film.

Also within the scope of the present invention is the use of nonwovens comprised of one or more bonded webs of modifier-treated polyolefin fiber- and/or fiber-like (fibrillated film) components having a mixed fiber denier of homogeneous and/or bicomponent types not exceeding about 40 dpf. Such webs preferably utilize fiber or filaments within a range of about 0.1–40 dpf.

In addition, the resulting nonwoven material can be embossed and/or calender printed conventionally with various designs and colors, as desired, to increase loft, augment wet strength, and provide easy market identification.

In further addition, webs used in forming nonwovens within the scope of the present invention are produced from one or more types of conventionally spun fibers or filaments having, for instance, round, delta, trilobal, or diamond cross sectional configurations, or mixtures thereof.

Nonwoven cover stock of the above-defined types can usefully vary in weight from about 10–45 gm $yd^2$ or higher.

The invention is further illustrated but not limited by the following Example and Tables:

EXAMPLE 1

A. Polypropylene fiber samples S-1 and S-2 are separately spun from separate resin batches in flake form generally characterized as follows:

crystallinity 60%, molecular weight distribution 6.4 melt flow 3.2 g/10 minutes which are individually processed in an impact blender. After 30 minutes the spun mixes having MFR values within a range of 24–27, are spun through a 210 circular hole spinnerette at 280° C. The resulting spun filament, is air quenched at room temperature, and stretched at 115° C. (4×) to obtain 2.0–2.54 dpf circular filaments, to which spin and over finishes are applied upstream and downstream of conventional crimping steps by passing the test filaments over a feed or kiss wheel partly immersed in a first modifier finish composition consisting of Lurol® AS-Y(*1)/LE458HS polysiloxane emulsion(*2) (5%/95% by weight), contact being of sufficient duration to topically apply about 0.40% and 0.59% based on dried spin composition (based on tow weight). The coated continuous filaments are then conventionally batch crimped at 100° C. and thereafter passed over a second kiss roll at sufficient speed and concentration to coat the spun finished fiber with an over finish consisting of 100% Lurol AS-Y to impart 0.1% overfinish to the fiber.

*1 A neutralized phosphoric acid/alcohol ester product of George A. Goulston Company of Monroe, N.C.

2 LE-458HS, a product of Union Carbide Corporation.

After air drying, the coated and processed test fiber is chopped to 1.5" length staple and set aside for conventional tests. Test results are summarized and reported in Table I below, in which the relative retained hydrophobicity as determined by fiber contact angle(*3) of the processed fiber is indicated in column 3 and the relative amounts of spinned finish (first modifier) an over finish (second modifier) are set out in columns 5 and 6 and by footnote.

(*3) % of fiber having a contact angle greater than 90

B. Polypropylene samples S-3 through S-6 obtained from a resin batch essentially as described in Example 1-A are spun, air quenched and crimped as described therein, using different spin finish (first modifier) and over finish (second modifier) compositions identically applied by using a Kiss roll to impart from 0.1%–0.5% (dry fiber weight) of spin finish and 0%–0.10% (dry fiber weight) over finish to obtain a total residual finish (after crimp) of about 0.2%–0.3% by weight. The crimping conditions are kept constant as an example in A. The observed waste (i.e. residue left on spool) and imparted crimp is also recorded in Table II below.

TABLE I

STAPLE PROPERTIES

| Sample # | Color Type | Degree of *4 Hydrophobicity | MFR | Percent by Weight Tow (*5) | Percent by Finish Staple (*6) | Fiber Dpf | Tenacity gms | Elongation % | Cpi | *5 Spin Fin. Type/AMT | *6 Over Fin. Type/AMT |
|---|---|---|---|---|---|---|---|---|---|---|---|
| S-1 | 195 | 5 | 26.8 | 0.4 | 0.3 | 2.0 | 2.10 | 236.6 | 34.1 | 262/0.6 | 263/0.1 |
| S-2 | 195 | 5 | 24.4 | 0.59 | 0.25 | 2.07 | 2.72 | 226.1 | 25.2 | 262/0.6 | 263/0.1 |

*4 Relative hydrophobicity of the finished and processed fiber;
1 = substantially hydrophilic,
5 = substantially hydrophobic.
*5 Finish #262:
95% Polydimethylsiloxane Emulsion (LE45BHS)
5% Lurol ASY
*6 Finish #263
100% Lurol ASY

TABLE II

| Sample | Spin Finish Type | Spin Finish Level | Over Finish | Over Finish Level | Total Finish | Crimps per Inch | Waste (%) |
|---|---|---|---|---|---|---|---|
| S-3 (*7) | 66% LE458HS, 33% Lurol ASY | 0.45% | None | 0.0% | 0.25% | 30.1 | 2.1% |
| S-4 | 50% LE458HS, 50% Lurol ASY | 0.36% | 50% LE458HS/50% Lurol ASY | 0.09% | 0.29% | 29.5 | 2.3% |
| S-5 | 50% LE458HS, 50% Lurol ASY | 0.25% | 50% LE458HS/50% Lurol ASY | 0.08% | 0.22% | 27.0 | 3.7% |
| S-6 | 100% Lurol ASY | 0.16% | 95% LE458HS/5% Lurol ASY | 0.10% | 0.20% | 24.0 | 4.45% |

*7 Sample Did Not Card Due to Jamming.

C. Polypropylene resin samples corresponding to those identified as samples S-3 and S-6 in Example 1B and Table II are routinely tested to determine differences in percent hydrophobicity*7 obtained in the processed and finished fiber utilizing different spin finish (step one) and over finish (step two) based on fiber contact angle determinations. Test results are reported in Table III below.

7 Wilhelmy; *The Physical Chemistry of Surfaces;* 3rd Ed. Wiley & Sons, 1976; page 344.

TABLE III

| FIBER | AVG.$^{\theta}$ a | RANGE OF$^{\theta}$ a | % HYDROPHOBICITY |
|---|---|---|---|
| S-6 | 97 | 80–110 | 95 |
| S-3 | 102 | 95–110 | 100 |

I claim:

1. A high crimp essentially hydrophobic polyolefin-containing fiber obtained by

A. initially treating corresponding continuous spun fiber or filament with an effective amount for fiber or filament processing of a first modifier composition comprising (a) up to about 40% by weight of modifier composition of at least one neutralized phosphoric acid ester represented by the formula $$(\mathrm{Alk-O})_n-\overset{\overset{\displaystyle O}{\|}}{\mathrm{P}}-(\mathrm{OR})_m \qquad (1)$$

wherein

Alk is individually defined as a lower alkyl group,

R is defined as an amino group or an alkali metal, n and m are individually defined as positive numbers of not less than 1, the sum of which is about 3; and (b) about 100%–60% by weight of modifier composition of at least one at least one polysiloxane represented by the formula $$\mathrm{X-(\overset{\overset{\displaystyle R'}{|}}{\underset{\underset{\displaystyle R'}{|}}{Si}}-O)_o-Y} \qquad (2)$$

wherein

X and Y are defined as hydrophobic chemical end groups,

R' is individually defined as a lower alkyl group, and o is defined as a positive number of at least about 10;

B. crimping and applying to said fiber or filament an effective amount for fiber or filament processing of an overfinish of a second modifier composition comprising (a) about 100%–50%, by weight of second modifier composition, of at least one neutralized phosphoric acid ester represented by formula (1); and (b) up to about 50%, by weight of second modifier composition, of at least one polysiloxane represented by formula (2) in sufficient amount to obtain a final cumulative concentration on the fiber within a range of about 0.01%–1.0% based on fiber weight.

2. The high crimp fiber of claim 1 wherein initial spin finish treatment of continuous spun fiber or filament is effected using about 50%–95%, by weight of first modifier composition, of at least one polysiloxane represented by formula (2).

3. The fiber of claim 1 wherein the Alk-O group of the neutralized ester is defined as a straight 1–4 carbon alkoxy group; n is 2; and m is 1.

4. The fiber of claim 3 wherein the second modifier composition is wholly applied downstream of said crimper.

5. The fiber of claim 2 wherein the second modifier composition is topically applied to an at least partially crimped continuous spun fiber or filament.

6. The fiber according to claim 1, wherein o is defined as a positive number of about 10 to 50.

7. A method for processing polyolefin-containing high crimp spun fiber or filament for production of nonwoven material of high hydrophobicity, comprising A. initially treating corresponding continuous spun fiber or filament with an effective amount for fiber or filament processing of a first modifier composition comprising (a) up to about 40% by weight of modifier composition of at least one neutralized phosphoric acid ester represented by the formula $$(\mathrm{Alk}-\mathrm{O})_n-\overset{\overset{\mathrm{O}}{\|}}{\mathrm{P}}-(\mathrm{OR})_m \qquad (1)$$

wherein

Alk is individually defined as a lower alkyl group,

R is defined as an amino group or an alkali metal, n and m are individually defined as positive numbers of not less than 1, the sum of which is about 3; and (b) about 100%–60% by weight of modifier composition of at least one at least one polysiloxane represented by the formula $$\mathrm{X}-(\overset{\overset{\mathrm{R'}}{|}}{\underset{\underset{\mathrm{R'}}{|}}{\mathrm{Si}}}-\mathrm{O})_o-\mathrm{Y} \qquad (2)$$

wherein

X and Y are individually defined as a hydrophobic chemical end group,

R' is individually defined as a lower alkyl group, and o is defined as a positive number of at least about 10;

B. crimping the resulting continuous fiber or filament in a crimper;

C. applying to the continuous fiber or filament, at a point proximate to the crimper, an effective amount for fiber or filament processing of an overfinish of a second modifier composition comprising (a) about 100%–50% by weight of second modifier composition, of at least one neutralized phosphoric acid ester represented by formula (1); and (b) up to about 50%, by weight of second modifier composition, of at least one polysiloxane represented by formula (2) in sufficient amount to obtain a final cumulative concentration on the fiber within a range of about 0.01%–1.0% based on fiber weight;

D. processing the resulting modifier-treated fiber or filament to obtain one or more webs for bonding; and E. bonding the resulting web(s) to obtain a desired hydrophobic nonwoven material.

8. The method of claim 7 wherein the Alk-O group of the neutralized phosphoric acid ester is defined as a straight 1–4 carbon alkoxy group; n is 2; and m is 1.

9. The method of claim 7 wherein at least some of the second modifier composition is topically applied upstream of the crimper.

10. The method of claim 7 wherein the second modifier composition is topically applied to an at least partially crimped continuous spun fiber or filament.

11. The method of claim 7 wherein the "D" processing step comprises a fiber cutting and carding operation.

12. The method of claim 7 wherein the second modifier composition comprises 0–15% by weight of a polysiloxane represented by formula (2).

13. The method according to claim 7, wherein o is defined as a positive number of about 10 to 50.

14. A method for preparing essentially hydrophobic polyolefin-containing fiber or filament, comprising:

treating continuous polyolefin-containing fiber or filament with:

a spin finish composition comprising:

at least one polysiloxane represented by the formula $$\mathrm{X}-(\overset{\overset{\mathrm{R'}}{|}}{\underset{\underset{\mathrm{R'}}{|}}{\mathrm{Si}}}-\mathrm{O})_o-\mathrm{Y}$$

wherein

X and Y are defined as hydrophobic chemical end groups,

R' is individually defined as a lower alkyl group, and o is defined as a positive number of at least about 10; crimping the polyolefin-containing fiber or filament; and subsequently treating the polyolefin-containing fiber or filament with at least one neutralized phosphoric acid ester represented by the formula $$(\mathrm{Alk}-\mathrm{O})_n-\overset{\overset{\mathrm{O}}{\|}}{\mathrm{P}}-(\mathrm{OR})_m$$

wherein

Alk is individually defined as a lower alkyl group, R is defined as an amino group or an alkali metal, n and m are individually defined as positive numbers of not less than about 1, the sum of which is about 3.

15. The method according to claim 14, wherein said at least one neutralized phosphoric acid ester is present in an over finish composition.

16. The method according to claim 14, wherein said at least one neutralized phosphoric acid ester is also present in said spin finish composition.

17. The method according to claim 14, wherein said at least one neutralized phosphoric acid ester is present in said spin finish composition and in an over finish composition.

18. The method according to claim 14, wherein the Alk-O group of the neutralized phosphoric acid ester is defined as a straight chain 1–4 carbon alkoxy group; n is 2; and m is 1.

19. The method according to claim 14, wherein o is defined as a positive number of about 10 to 50.

20. The method according to claim 14, wherein said at least one neutralized phosphoric acid ester is present in an over finish composition.

21. The method according to claim 20, wherein said over finish composition further comprises at least one polysiloxane represented by the formula $$\mathrm{X}-(\overset{\overset{\mathrm{R'}}{|}}{\underset{\underset{\mathrm{R'}}{|}}{\mathrm{Si}}}-\mathrm{O})_o-\mathrm{Y}$$

wherein

X and Y are defined as hydrophobic chemical end groups,

R' is individually defined as a lower alkyl group, and o is defined as a positive number of at least about 10.

22. The method according to claim 20, further comprising processing the polyolefin-containing fiber or filament subsequent to treatment with the over finish composition to obtain at least one web, and bonding the at least one web to obtain a hydrophobic nonwoven material.

23. The method according to claim 21, further comprising processing the polyolefin-containing fiber or filament subsequent to treatment with the over finish composition to obtain at least one web, and bonding the at least one web to obtain a hydrophobic nonwoven material.

24. The method according to claim 14, wherein said polyolefin-containing fiber or filament comprises a polypropylene fiber or filament.

25. A method for preparing essentially hydrophobic polyolefin-containing fiber or filament, comprising:

treating continuous polyolefin-containing fiber or filament with a spin finish composition, crimping the polyolefin-containing fiber or filament, and subsequently treating the crimped polyolefin-containing fiber or filament with an over finish composition;

about 100%–60% by weight of the spin finish composition comprising at least one polysiloxane represented by the formula $$X-(\overset{\overset{R'}{|}}{\underset{\underset{R'}{|}}{Si}}-O)_o-Y$$

wherein

X and Y are defined as hydrophobic chemical end groups,

R' is individually defined as a lower alkyl group, and o is defined as a positive number of at least about 10; and about 100%–50% by weight of the over finish composition comprising at least one neutralized phosphoric acid ester represented by the formula $$(Alk-O)_n-\overset{\overset{O}{||}}{P}-(OR)_m$$

wherein

Alk is individually defined as a lower alkyl group, R is defined as an amino group or an alkali metal, n and m are individually defined as positive numbers of not less than about 1, the sum of which is about 3.

26. The method according to claim 25, wherein the spin finish composition comprises about 100% by weight of the at least one polysiloxane.

27. The method according to claim 25, wherein the spin finish composition comprises about 100% by weight of the at least one polysiloxane, and the over finish composition comprises about 100% by weight of the at least one neutralized phosphoric acid ester.

28. The method according to claim 25, wherein said spin finish composition comprises up to about 40% by weight of at least one neutralized phosphoric acid ester represented by the formula $$(Alk-O)_n-\overset{\overset{O}{||}}{P}-(OR)_m$$

wherein

Alk is individually defined as a lower alkyl group, R is defined as an amino group or an alkali metal, n and m are individually defined as positive numbers of not less than about 1, the sum of which is about 3.

29. The method according to claim 25, wherein said over finish composition comprises up to about 50% by weight of at least one polysiloxane represented by the formula $$X-(\overset{\overset{R'}{|}}{\underset{\underset{R'}{|}}{Si}}-O)_o-Y$$

wherein

X and Y are defined as hydrophobic chemical end groups,

R' is individually defined as a lower alkyl group, and o is defined as a positive number of at least about 10.

30. The method according to claim 25, wherein:

said spin finish composition comprises up to about 40% by weight of at least one neutralized phosphoric acid ester represented by the formula $$(Alk-O)_n-\overset{\overset{O}{||}}{P}-(OR)_m$$

wherein

Alk is individually defined as a lower alkyl group, R is defined as an amino group or an alkali metal, n and m are individually defined as positive numbers of not less than about 1, the sum of which is about 3; and said over finish composition comprises up to about 50% by weight of at least one polysiloxane represented by the formula $$X-(\overset{\overset{R'}{|}}{\underset{\underset{R'}{|}}{Si}}-O)_o-Y$$

wherein

X and Y are defined as hydrophobic chemical end groups,

R' is individually defined as a lower alkyl group, and o is defined as a positive number of at least about 10.

31. The method according to claim 25, wherein the over finish composition comprises about 100% by weight of the at least one neutralized phosphoric acid ester.

32. The method according to claim 31, wherein said spin finish composition comprises up to about 40% by weight of at least one neutralized phosphoric acid ester represented by the formula $$(Alk-O)_n-\overset{\overset{O}{||}}{P}-(OR)_m$$

wherein

Alk is individually defined as a lower alkyl group, R is defined as an amino group or an alkali metal, n and m are individually defined as positive numbers of not less than about 1, the sum of which is about 3.

33. A method for processing polyolefin-containing high crimp spun fiber or filament for production of nonwoven material of high hydrophobicity, comprising:

A. initially treating corresponding continuous spun fiber or filament with an effective amount of a first modifier finish composition comprising (a) up to about 40% by weight of modifier composition of at least one neutralized phosphoric acid ester represented by the formula $$(Alk-O)_n-\overset{\overset{\displaystyle O}{\|}}{P}-(OR)_m \quad (1)$$

wherein

Alk is individually defined as a lower alkyl group, R is defined as an amino group or an alkali metal, n and m are individually defined as positive numbers of not less than about 1, the sum of which is about 3; and (b) about 100%–60% by weight of first modifier composition of at least one polysiloxane represented by the formula $$X-(\overset{\overset{\displaystyle R'}{|}}{\underset{\underset{\displaystyle R'}{|}}{Si}}-O)_o-Y \quad (2)$$

wherein

X and Y are defined as hydrophobic chemical end groups,

R' is individually defined as a lower alkyl group, and o is defined as a positive number of at least about 10;

B. crimping the resulting continuous fiber or filament;

C. applying to the continuous fiber or filament, at a point proximate to the crimper, an overfinish of a second modifier composition comprising at least one neutralized phosphoric acid ester represented by formula (1);

D. processing the resulting modifier-treated fiber or filament to obtain and compile at least one web for bonding; and E. bonding the resulting at least one web.

34. The method according to claim 33, wherein the overfinish composition comprises about 100% by weight of the at least one neutralized phosphoric acid ester.

* * * * *